US010429782B2

(12) United States Patent
Honke et al.

(10) Patent No.: US 10,429,782 B2
(45) Date of Patent: Oct. 1, 2019

(54) FIXING DEVICE HAVING A PREVENTING MEMBER THAT PREVENTS FOLDING OF AN END PORTION OF A FILM

(71) Applicant: CANON KABUSHIKI KAISHA, Tokyo (JP)

(72) Inventors: Takashi Honke, Mishima (JP); Satoru Taniguchi, Mishima (JP); Masaki Hirose, Suntou-gun (JP); Taisuke Minagawa, Suntou-gun (JP); Keita Nakajima, Mishima (JP); Kazushi Nishikata, Tokyo (JP); Fumiki Inui, Mishima (JP); Koichi Yamada, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/869,238

(22) Filed: Jan. 12, 2018

(65) Prior Publication Data

US 2018/0203390 A1 Jul. 19, 2018

(30) Foreign Application Priority Data

Jan. 13, 2017 (JP) ..... 2017-003824

(51) Int. Cl.
*G03G 15/20* (2006.01)

(52) U.S. Cl.
CPC ..... *G03G 15/2053* (2013.01); *G03G 15/2017* (2013.01); *G03G 15/2028* (2013.01);
(Continued)

(58) Field of Classification Search
CPC ..... G03G 15/2017; G03G 15/2053; G03G 15/755; G03G 2215/00151;
(Continued)

(56) References Cited

U.S. PATENT DOCUMENTS 5,257,078 A * 10/1993 Kuroda ..... H05B 3/12 219/216
8,737,896 B2 5/2014 Fujita et al.
(Continued)

FOREIGN PATENT DOCUMENTS

JP 2007086267 A * 4/2007
JP 2012008377 A * 1/2012
(Continued)

OTHER PUBLICATIONS

Office Action dated May 22, 2018, issued in Japanese Patent Application No. 2017-003824.
(Continued)

*Primary Examiner* — Robert B Beatty
(74) *Attorney, Agent, or Firm* — Venable LLP

(57) ABSTRACT

A fixing device includes a cylindrical film a pressing member, and a preventing member including a preventing surface configured to prevent movement of the film in a longitudinal direction, and a film rotation guiding surface. As viewed in the longitudinal direction of the film, the preventing surface includes first and second regions positioned downstream and upstream, respectively, of a nip center line with respect to a recording material feeding direction. The first region retracts from a longitudinal film end surface relative to the second region. The second region continuously extends in the recording material feeding direction from a portion upstream of the nip center line to a portion downstream of the nip center line, and has a length, with respect to a rotational direction of the film, that is greater at the portion upstream of the nip center line than at the portion downstream of the nip center line.

19 Claims, 10 Drawing Sheets

(52) U.S. Cl.
CPC ..... *G03G 2215/00151* (2013.01); *G03G 2215/2035* (2013.01)

(58) Field of Classification Search
CPC ... G03G 2215/2009; G03G 2215/2016; G03G 2215/2035
USPC ..... 399/165, 329; 474/122, 140
See application file for complete search history.

(56) References Cited

U.S. PATENT DOCUMENTS

| | | | | |
|---|---|---|---|---|
| 8,798,514 | B2 | 8/2014 | Tanaka et al. | |
| 9,002,249 | B2 * | 4/2015 | Uekawa | G03G 15/2064 399/329 |
| 9,400,456 | B2 * | 7/2016 | Iwakoshi | G03G 15/1615 |
| 9,639,044 | B2 | 5/2017 | Hayashi et al. | |
| 9,778,607 | B2 * | 10/2017 | Kawaguchi | G03G 15/2053 |
| 2014/0301760 | A1 * | 10/2014 | Nanjo | G03G 15/2053 399/329 |
| 2018/0017912 | A1 * | 1/2018 | Lee | G03G 15/2053 |

FOREIGN PATENT DOCUMENTS

| | | | |
|---|---|---|---|
| JP | 2012-252186 | A | 12/2012 |
| JP | 2013-041062 | A | 2/2013 |
| JP | 2013-130792 | A | 7/2013 |
| JP | 2017-003871 | A | 1/2017 |
| JP | 2017-161582 | A | 9/2017 |

OTHER PUBLICATIONS

Office Action dated Oct. 2, 2018, issued in Japanese Patent Application No. 2017-003824, (not in English).

* cited by examiner (a) Hl = Hr (b) Hl < Hr

FIXING DEVICE HAVING A PREVENTING MEMBER THAT PREVENTS FOLDING OF AN END PORTION OF A FILM

CLAIM TO PRIORITY

This application claims the benefit of Japanese Patent Application No. 2017-003824 filed on Jan. 13, 2017, which is hereby incorporated by reference herein in its entirety.

FIELD OF THE INVENTION AND RELATED ART

The present invention relates to a fixing device (image heating device) mounted in an image forming apparatus, such as a copying machine, a printer, a facsimile machine, or a multi-function machine having a plurality of functions of these machines.

As the fixing device (image heating device) used in the image forming apparatus of an electrophotographic type, a fixing device of a film (belt) heating type has been known. Specifically, the fixing device includes a cylindrical film having a high heat-resistant property, a ceramic heater contacting an inner surface of the film, and a pressing roller for forming a nip in cooperation with the heater through the film. In the nip, a recording material on which a toner image is carried is heated while being fed, so that the toner image is fixed on the recording material. The heater and the film used in this fixing device are low in thermal capacity, and, therefore, there is an advantage such that it becomes possible to realize power saving and wait time reduction (quick start).

In this fixing device, during film rotation, a shift of the film in a longitudinal direction (thrust direction) generates in some cases, and it is difficult to control this shift with accuracy. Therefore, it has been proposed that a preventing member (hereafter referred to as a flange) for suppressing the shift while receiving an end portion of the film with respect to the longitudinal direction is provided at the film end portion. This flange contacts an inner peripheral surface and an end surface of the film. The flange suppresses inclination of the film with respect to a recording material feeding direction by contact thereof with the inner peripheral surface of the film and prevents movement of the film in the longitudinal direction by contact thereof with the end surface of the film.

In a case in which the movement of the film is prevented by the flange, however, when a shifting force of the film increases, a phenomenon such that the film causes folding or a crack at the end portion (hereafter, this phenomenon is referred to as film end portion breakage) generates in some cases. As a result, there was a possibility of a deterioration of a fixed image, improper traveling of the film, and shortening of a durable lifetime. As countermeasures thereof, an increase in film thickness and enhancement of strength by mixing of a material with an additive, or the like, are carried out.

Further, there is a need to properly control a relationship between a region where the flange contacts an inner peripheral surface of the film (hereafter, referred to as a guiding surface) and a contact region of the flange with the film (hereafter referred to as a preventing (regulating) surface). When a film end surface contacts the preventing surface of the flange in a region where the flange does not contact the inner peripheral surface of the film, a phenomenon such that the film folds to an end portion thereof (hereafter, referred to as an end portion folding) generates. On the film that generated the end portion folding, there is a possibility that a traveling locus becomes unstable and thus, an image defect and improper feeding of the recording material are caused. Further, the end portion folding also leads to the film end portion breakage in some cases.

In order to solve the problem of the end portion folding, Japanese Laid-Open Patent Application (JP-A) 2012-252186 proposes a countermeasure such that a flange shape is devised. Features of this proposed constitution are as follows. When the flange is divided with respect to a nip center line into two sides, i.e., an upstream side and a downstream side along a recording material feeding direction, in the upstream side, the flange contacts the inner peripheral surface and the end surface of the film. Further, a region where the film inner peripheral surface and the guiding surface are in contact with each other is larger than a region where the film end surface and the preventing surface are in contact with each other. On the other hand, in the downstream side, the flange does not contact the inner peripheral surface and the end surface of the film.

By employing the above-described constitution, in the region where the inner peripheral surface of the film and the guiding surface of the flange do not contact each other, contact of the end surface of the film with the preventing surface of the flange is prevented, so that it is possible to prevent the end portion folding.

In the above-described constitution (prior art), however, with speed-up and downsizing of the apparatus in recent years, there was a problem such that a shifting force of the film increases. That is, in the case of the constitution such that only in the upstream side, the film inner peripheral surface and the flange guiding surface are in contact with each other and the film end surface and the preventing surface of the flange are in contact with each other, the shifting force exerted on the film increases. The reason therefor is as follows.

In the conventional constitution, in the downstream side of the flange, a gap generates between the inner peripheral surface of the film and the guiding surface of the flange. When such a gap generates, an inclination of the film with respect to the recording material feeding direction of the film generates. When the film inclines with respect to the pressing roller, a difference in vector in the rotational direction between the film and the pressing roller generates, so that the shifting force generates at the film end portion depending on the difference. When the vector difference with the rotational direction increases and thus the shifting force increases, there was a liability that the traveling locus of the film is disturbed or that the film breaks at its end portion.

As a means for solving this problem, a method of enlarging the guiding surface of the flange or a method in which the film inner peripheral surface and the flange guiding surface are caused in contact with each other also in the downstream side by a means, such as a decrease in diameter, are employed. Thus, also in the downstream side, by contacting the film inner peripheral surface and the flange guiding surface with each other, the inclination of the film relative to the pressing roller with respect to the recording material feeding direction is suppressed, so that the shifting force can be reduced.

Also as regards the contact between the film end surface and the preventing surface of the flange, in a case in which these surfaces contact each other only in the upstream side, there was a problem that with respect to a predetermined shifting force, a shifting force per unit area exerted on the film increases. In order to solve this problem, a means for reducing the film shifting force per unit area by increasing a contact area through the contact between the film end surface and the preventing surface of the flange also in the downstream side is employed.

As described above, in an apparatus in which the inner peripheral surface of the film and the guiding surface of the flange are in contact with each other and the end surface of the film and the preventing surface of the flange are in contact with each other also in the downstream side, there is a need to prevent the end portion folding of the film.

SUMMARY OF THE INVENTION

According to an aspect of the present invention, there is provided a fixing device comprising a cylindrical film, a pressing member configured to form a nip in cooperation with the film while contacting an outer surface of the film, and a preventing member provided at a longitudinal end portion of the film and contactable to a longitudinal end surface of the film when the film moves in a longitudinal direction of the film, wherein the preventing member includes a preventing surface configured to prevent movement of the film in the longitudinal direction of the film and a guiding surface opposing an inner surface of the film and configured to guide rotation of the film, wherein in the nip, a recording material on which an image is formed is heated while being fed, and the image is fixed on the recording material, wherein as viewed in the longitudinal direction of the film, the preventing surface includes a first region positioned downstream of a nip center line with respect to a recording material feeding direction and a second region positioned upstream of the first region with respect to the recording material feeding direction, and the first region retracts in a direction of retracting from the longitudinal end surface of the film with respect to the longitudinal direction relative to the second region, and wherein the second region continuously extends in the recording material feeding direction from a portion upstream of the nip center line to a portion downstream of the nip center line, and the second region has a length, with respect to a rotational direction of the film, longer at the portion upstream of the nip center line than at the portion downstream of the nip center line.

Further features of the present invention will become apparent from the following description of exemplary embodiments with reference to the attached drawings.

Figure 9:
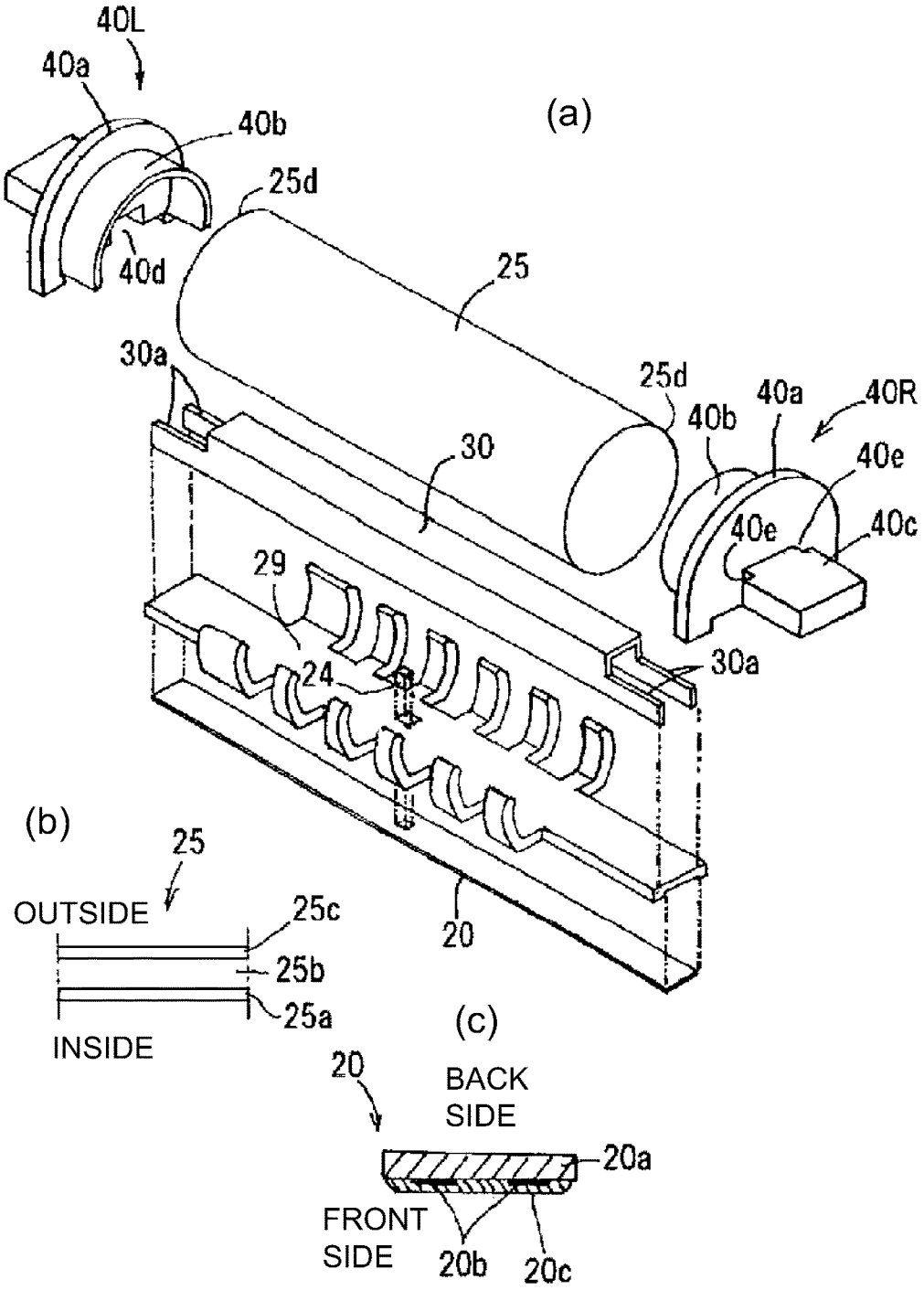

Part (a) of FIG. 9 is an exploded schematic perspective view of a film unit, part (b) of FIG. 9 is a schematic view showing a layer structure of a film, and part (c) of FIG. 9 is a schematic cross-sectional view of a heater.

Figure 10:
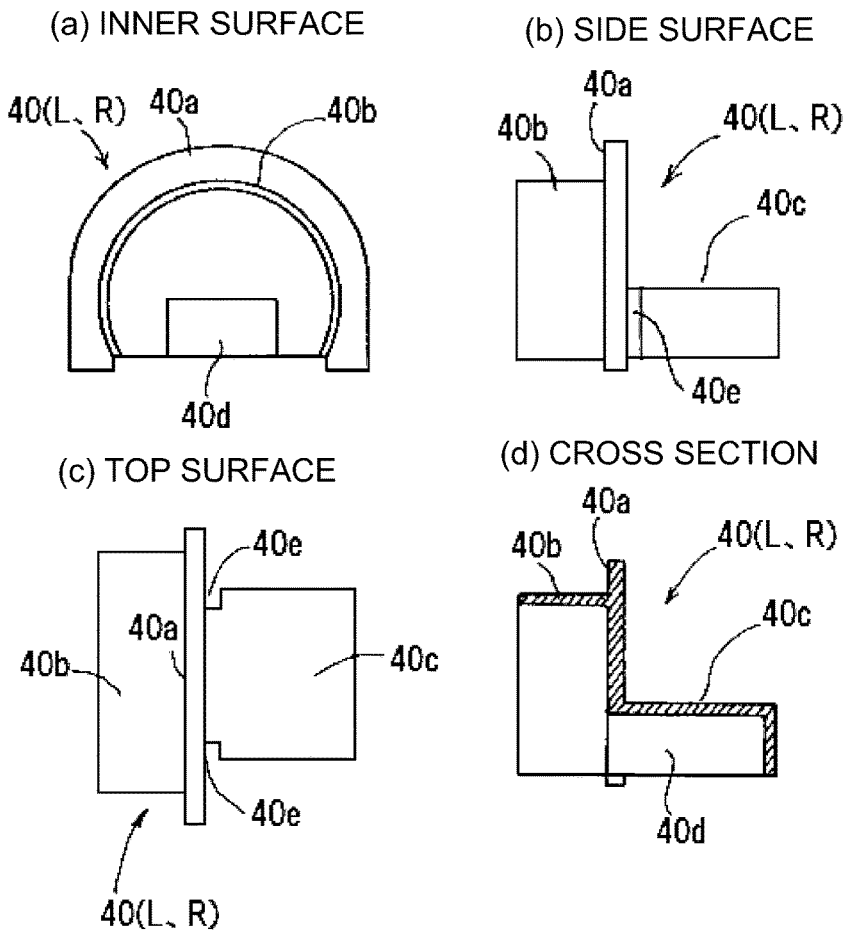

Parts (a) to (d) of FIG. 10 are schematic views for illustrating a structure of a flange.

Figure 11:
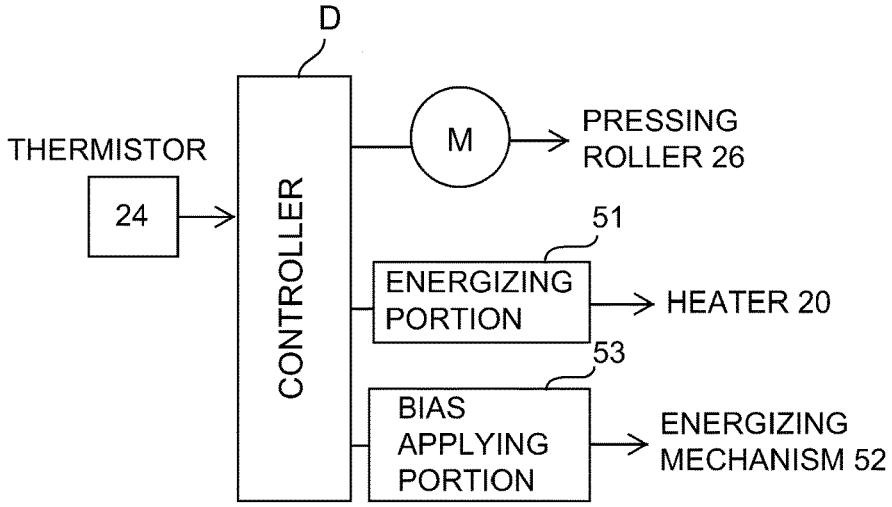

FIG. 11 is a block diagram of a control system.

Figure 12:
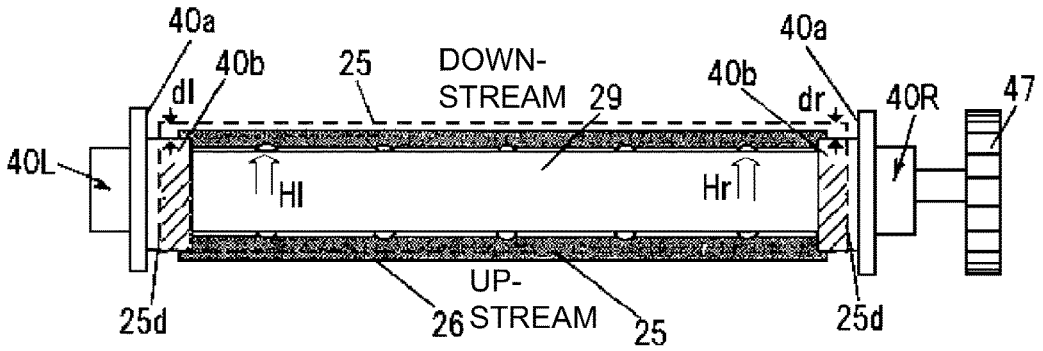
Figure 12:
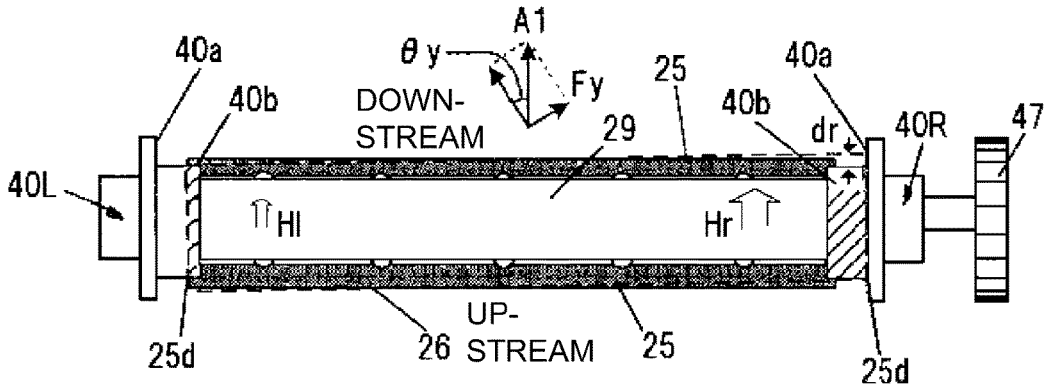

Parts (a) and (b) of FIG. 12 are schematic views for illustrating shift movement of the film.

Figure 13:
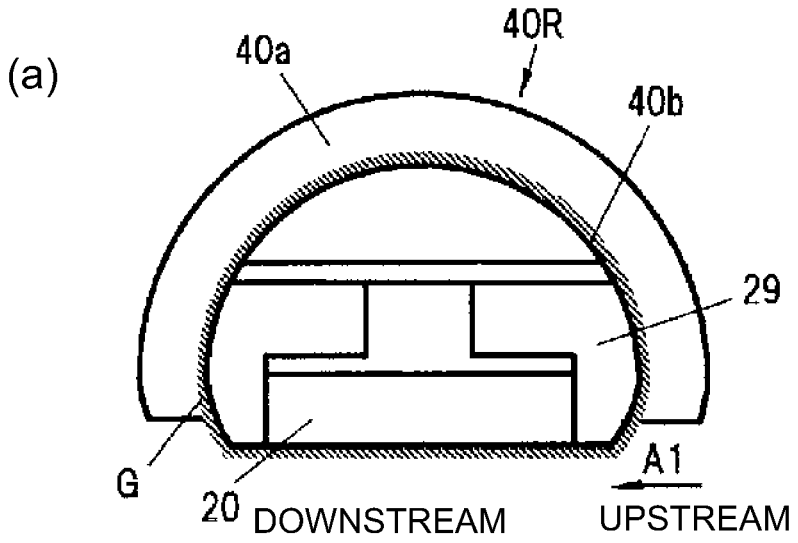
Figure 13:
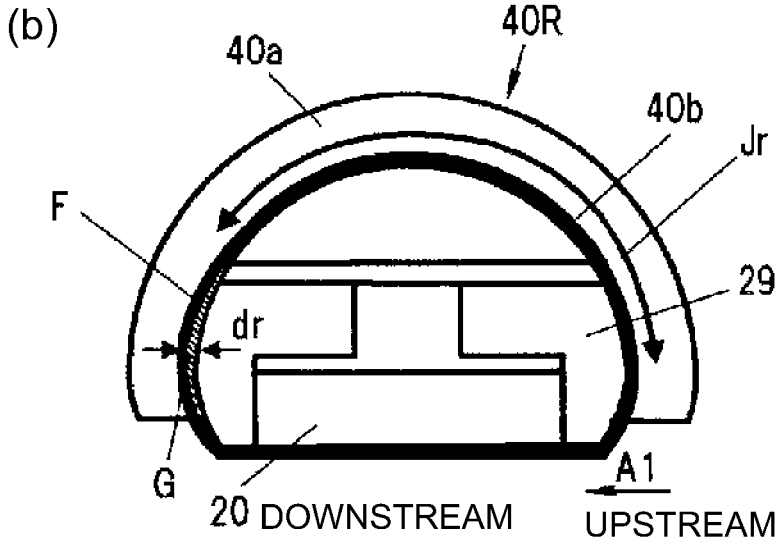

Parts (a) and (b) of FIG. 13 are schematic views for illustrating a guiding region and a traveling locus of the film.

Figure 14:
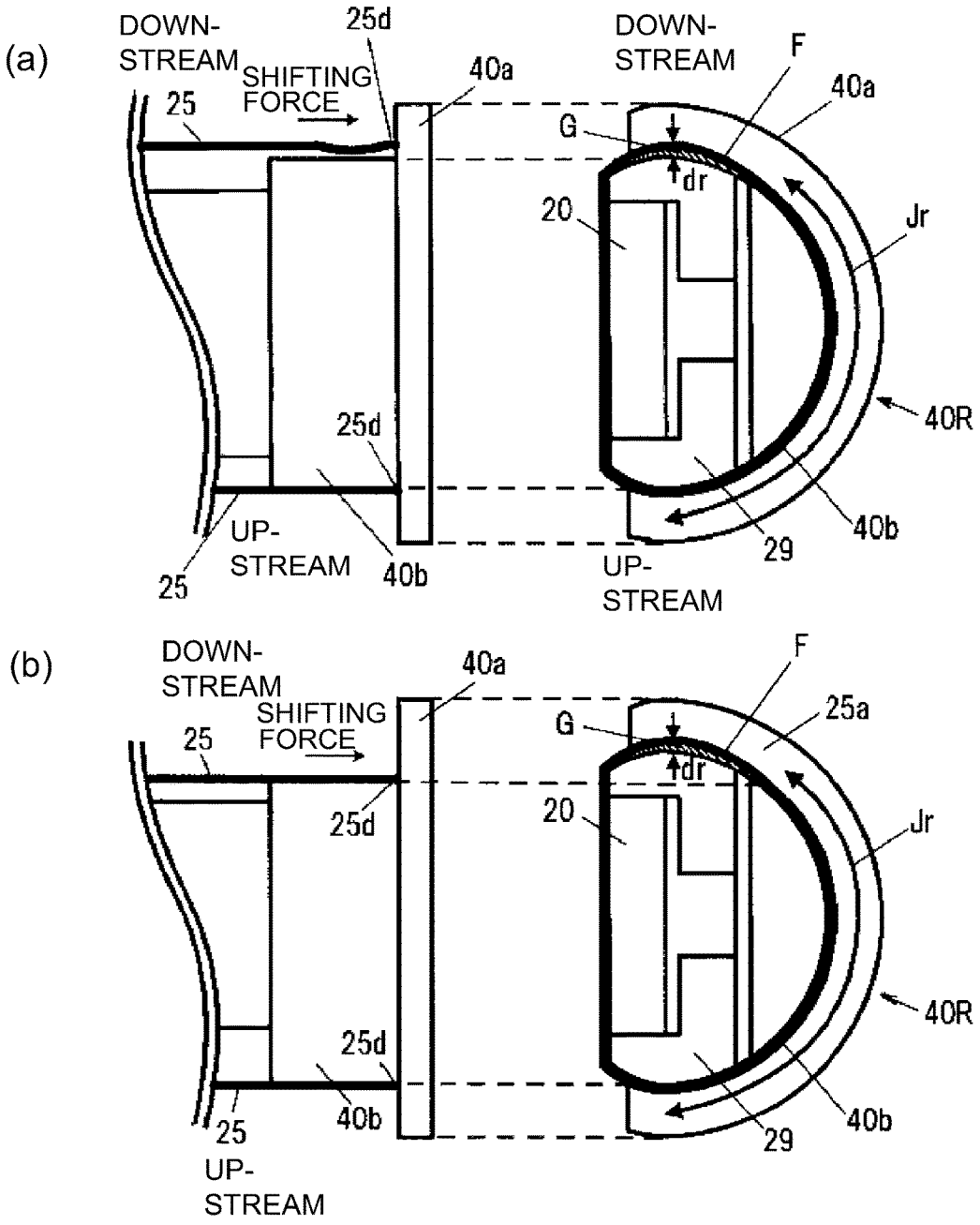

Parts (a) and (b) of FIG. 14 are schematic views for illustrating film folding.

Figure 15:
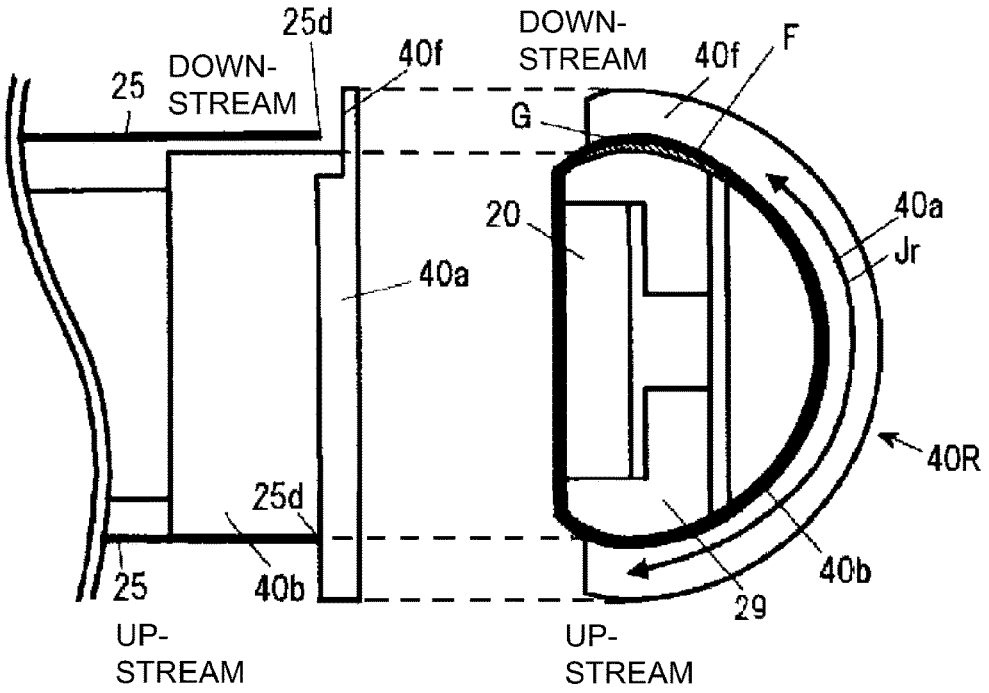

FIG. 15 is a schematic view for illustrating a flange provided with a taper-shaped portion.

Figure 16:
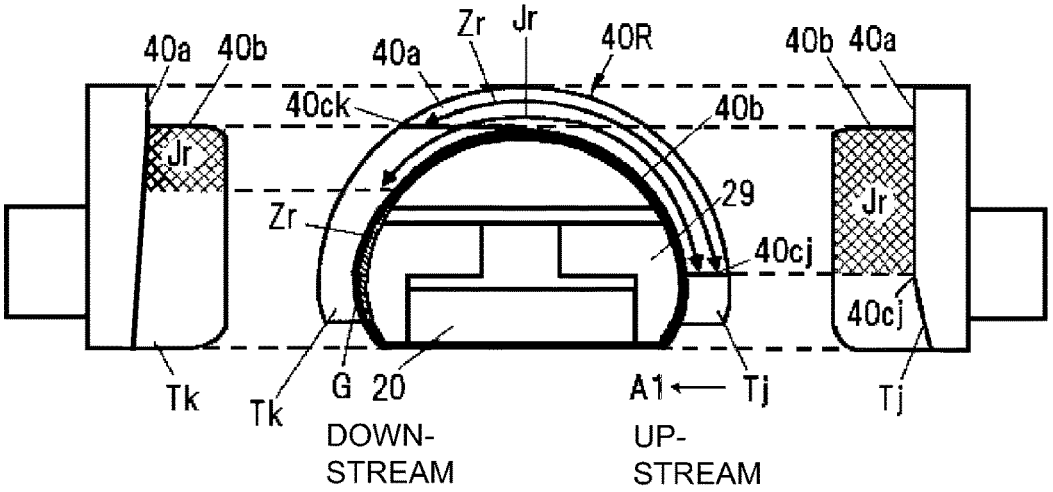

FIG. 16 is a schematic view for illustrating flanges in a modified embodiment of Embodiment 1.

DESCRIPTION OF EMBODIMENTS

Embodiments of the present invention will be specifically described with reference to the drawings.

Embodiment 1

Image Forming Apparatus

Figure 4:
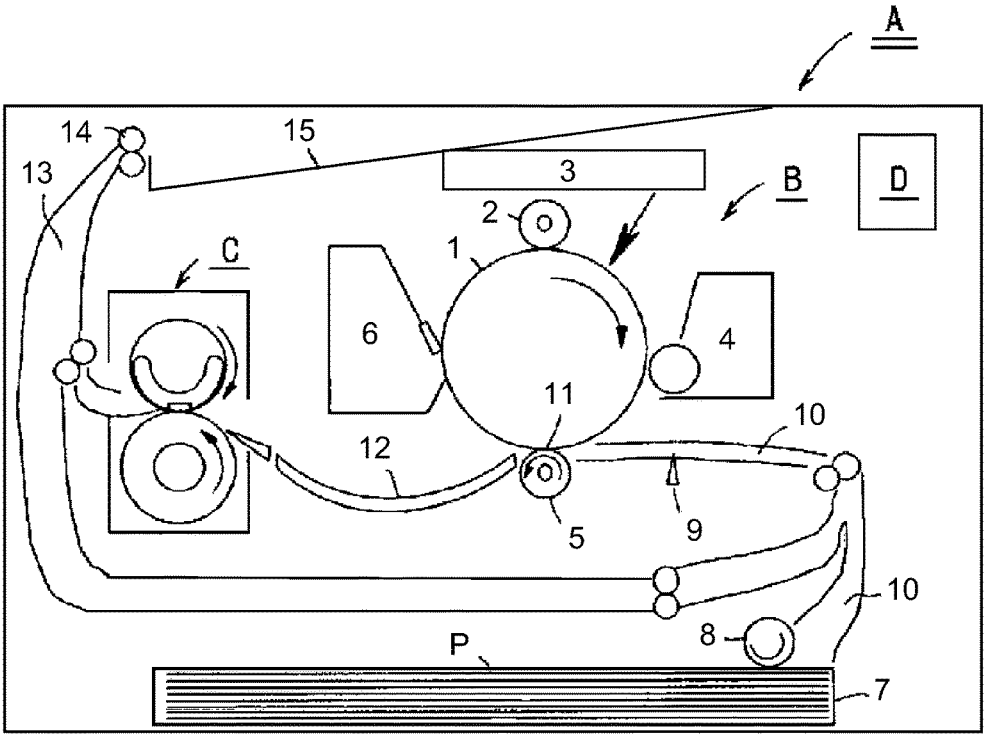
FIG. 4 is a schematic structural view of an example of an image forming apparatus.

FIG. 4 is a schematic view showing a general structure of an example of an image forming apparatus A in which an image heating apparatus is mounted as a fixing device C according to the present invention. The image forming apparatus A is a monochromatic printer using an electrophotographic process, and image information is inputted from an external device (not shown), such as a host computer, to a controller D. The controller D executes a predetermined image forming control sequence.

An image forming portion B for forming a toner image on a recording material (hereafter, referred to as a sheet or paper) P includes a drum-shaped electrophotographic photosensitive member (hereafter, referred to as a drum) 1 rotationally driven in the clockwise direction indicated by an arrow. At a periphery of this drum 1, in the order along a rotation direction, a charging roller 2, a laser scanner 3, a developing device 4, a transfer roller 5, and a cleaning device 6 are provided. An image forming operation (electrophotographic process) of the image forming portion B is well known and will be omitted from the detailed description.

Sheets P accommodated in a cassette 7 are fed one by one by rotation of a feeding roller 8. Then, the sheet P is introduced, along a feeding path 10 including a top sensor 9, at predetermined control timing to a transfer nip 11 formed by the drum 1 and the transfer roller 5 and is subjected to transfer of the toner image formed on the drum 1 side. The sheet P, having passed through the transfer nip 11, is sent to a fixing device (fixing portion) C along a feeding path 12 and is subjected to a heat pressure fixing process of the toner image. The sheet P coming out of the fixing device C passes through a feeding path 13 and is discharged as an image-formed product onto a discharger tray 15 by a discharging roller 14.

Fixing Device

As regards the fixing device C, a front surface (side) is an entrance side of the sheet P, and a rear (back) surface (side) is an exit side of the sheet P. Left and right refer to a left side (one end side) and a right side (the other end side) when the fixing device C is seen from the front side. Upper (up) and lower (down) refer to those portions with respect to a direction of gravitation. Upstream side and downstream side refer to those sides with respect to a sheet feeding direction (recording material feeding direction). Further, an axial direction of a pressing roller or a direction parallel to the axial direction is a longitudinal direction, and a direction perpendicular to the longitudinal direction is a widthwise direction.

Figure 5:
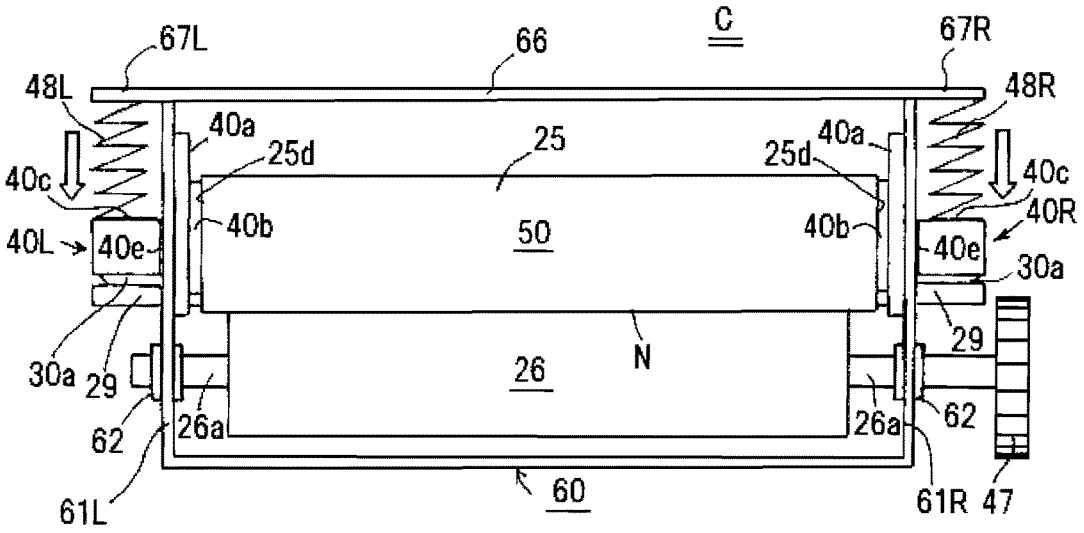
FIG. 5 is a schematic front view of an example of the fixing device.
Figure 6:
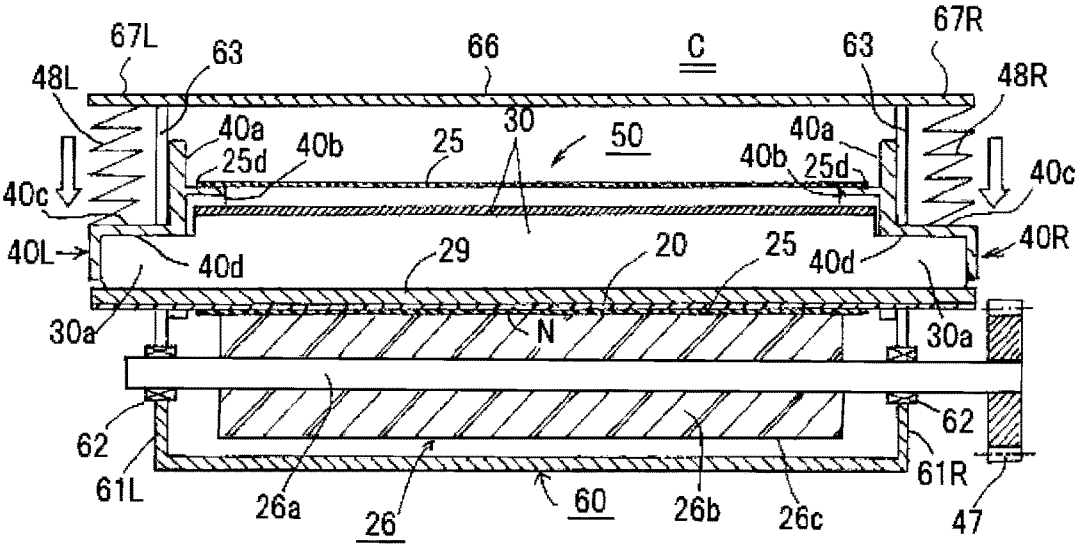
FIG. 6 is a schematic longitudinal front view of the fixing device.
Figure 7:
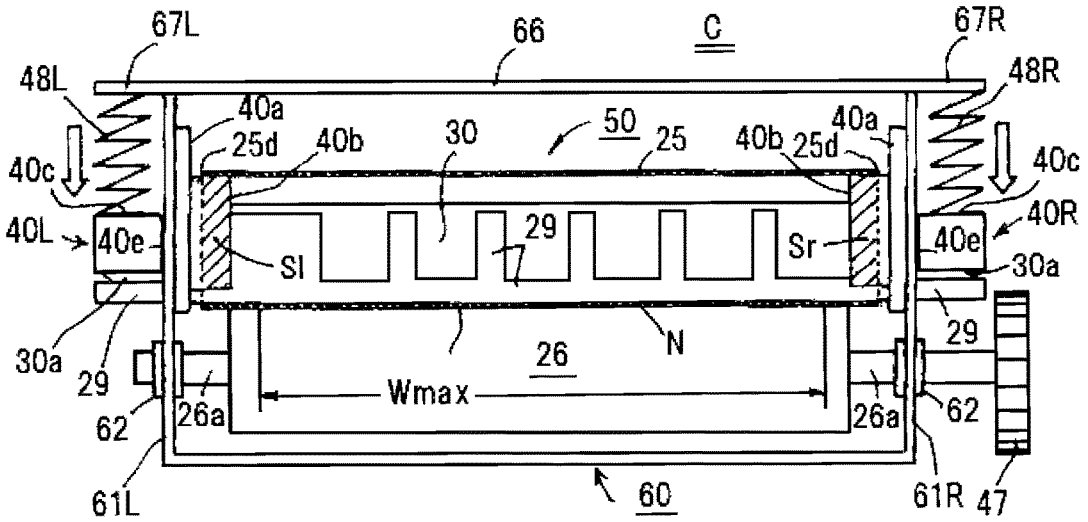
FIG. 7 is a schematic front view of the fixing device of FIG. 5 from which a part is cut off.
Figure 8:
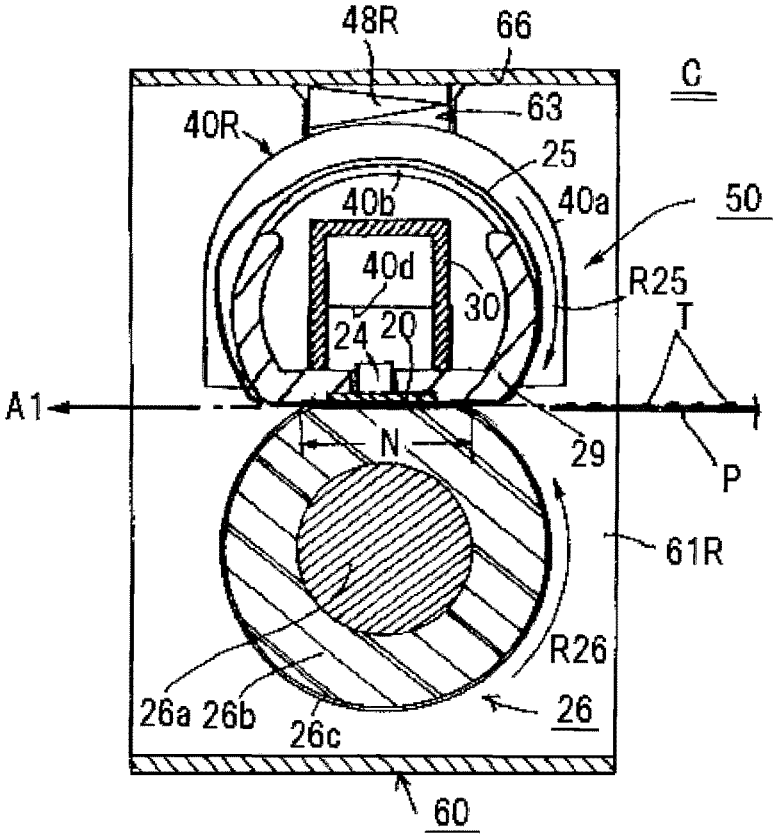
FIG. 8 is a schematic cross-sectional left side view of the fixing device.

The fixing device C is an image heating device (or an on-demand fixing device (OMF)) of a film (belt) heating type enabling shortening of a rise time and low power consumption. FIG. 5 is a schematic front view of the fixing device C, and FIG. 6 is a schematic longitudinal front view of the fixing device C. FIG. 7 is a schematic view of the fixing device C in a state in which in the schematic front view of the fixing device C in FIG. 5, in which a film of a film unit is cut off and an inside of the film unit is in sight. FIG. 8 is a schematic cross-sectional left side view of the fixing device C. The fixing device C roughly includes a film unit (belt unit) 50, an elastic pressing roller 26 as a pressing member, and a device frame (casing) 60 accommodating these members.

(1) Film Unit 50

The film unit 50 includes a fixing film (or a fixing belt, hereafter referred to as a film) 25 that is loosely fitted around an inner assembly (incorporated member, internal member) and that is a flexible and hollow (endless, endless belt-shaped, cylindrical) first rotatable member. Inside the film 25, a heater 20 as a heating member, a guiding member (holding member) 29, not only holding the heater 20, but also guiding rotation of the film 25, and a rigid pressing stay 30, formed of, e.g., iron, for holding the guiding member 29 are provided as the inner assembly. Part (a) of FIG. 9 is an exploded schematic perspective view of the film unit 50.

Each of the heater 20, the guiding member 29, and the stay 30 is an elongated member having a length greater than a width (length) of the film 25, and extends outwardly from each of ends of the film 25 on an associated side, i.e., on one end side (left side) or the other end side (right side). Further, flanges (film holding members, preventing (regulating) members) 40(L,R) on one end side and the other end side are engaged with outwardly projected portions 30*a* of the stay 30 on the one end side and the other end side, respectively. That is, at end portions of the film 25 with respect to the longitudinal direction, the flanges 40(L,R) are disposed.

(a) Film 25

The flexible film 25 assumes a cylindrical shape of 24 mm in diameter by its own elasticity in a free state. The film 25 is loosely fitted around the guiding member 29 having a substantially semi-cylindrical (arcuate) shape in cross section. Part (b) of FIG. 9 is a schematic sectional view showing a layer structure of the film 25 in this embodiment, in which in the order from an inside to an outside, a base layer 25*a*, an elastic layer 25*b* and a surface layer 25*c*, which constitute a three-layer composite layer, are formed.

As a material of the base layer 25*a*, in many fixing devices, a heat-resistant resin material having low heat capacity, such as polyimide, polyamideimide, polyether ether ketone (PEEK), or polyether sulfone (PES), is used, but in order to enhance a heat-conductive property and durability, it is also possible to use a thin metal, such as stainless steel (SUS) or nickel. The base layer 25*a* is required to satisfy not only a quick start property by decreasing a heat capacity, but also a mechanical strength, and, therefore, a thickness thereof may desirably be 15 μm or more and 50 μm or less. As the base layer 25*a* in this embodiment, a 70 μm-thick cylindrical polyimide base layer was used.

The elastic layer 25*b* uses a silicone rubber as a material. By providing the elastic layer 25*b*, the toner image T can be incorporated and thus, heat is uniformly imparted to the toner image T, and, therefore, it becomes possible to obtain an image having a high glossiness and a good quality free from unevenness. Further, the elastic layer 25*b* is low in heat-conductive property in the form of a silicone rubber, and, therefore, a thermal conductivity of 1.2 W/mk or more may preferably be ensured by a means, such as the addition of a heat-conductive filler, such as alumina, metallic silicon, silicon carbide, or zinc oxide, or by a like means.

In this embodiment, as the elastic layer 25*b*, as the heat-conductive filler, metallic silicon is added to dimethylpolysiloxane as a rubber material, and thus, the thermal conductivity of the elastic layer 25*b* is 1.2 W/mK. A thickness of the elastic layer 25*b* is 210 μm.

The surface layer 25*c* is required, as a parting layer, to have a high anti-wearing property and a high parting property from the toner. As a material thereof, a fluorine-containing resin material, such as perfluoroalkoxy alkane (PFA), polytetrafluoroethylene (PTFE), or fluorinated ethylene propylene (FEP), is used. The surface layer 25*c* is formed as a coating layer obtained by baking a dispersion of the resin material or as a tube layer. In some cases, an electroconductive material, such as carbon black, is added to the fluorine-containing resin material. As regards the surface layer 25*c* in this embodiment, PFA was used as the fluorine-containing resin material, and was formed as the coating layer in a thickness of 15 μm.

(b) Heater 20

As the heater 20, a ceramic heater is used in general. Part (c) of FIG. 9 is a schematic cross-sectional view of a ceramic heater 20 in this embodiment. This heater 20 includes a heat-resistant heater substrate (ceramic substrate) 20*a* formed of aluminum nitride or alumina. On the surface of the heater substrate 20*a*, a resistor pattern 20*b* as a heat generating resistor layer (heat generating resistor) generating heat by energization is formed along a longitudinal direction of the heater substrate 20*a* by printing, for example. Then, the surface of the resistor pattern 20*b* is coated with a gloss layer 20*c* as a protective layer.

On a back (rear) surface (opposite from the nip N), a thermistor 24 as a temperature detecting member for detecting a temperature of the heater 20 is provided.

(c) Guiding Member 29

The guiding member 29 is a member formed of a heat-resistant resin material, and not only supports the heater 20, but also functions as a rotation guide of the film 25. At a lower surface of the guiding member 29, a groove portion is formed along the longitudinal direction, and the heater 20 is engaged in the groove portion with its front surface outward and thus, is supported by the groove portion. As a material of the guiding member 29, a heat-resistant resin material, such as a liquid-crystal polymer, a phenolic resin material, polyphenylene sulfide (PPS) or PEEK is used.

(d) Flange 40

The flanges 40(L,R) disposed at the end portions of the film 25 with respect to the longitudinal direction are mold products formed of the heat-resistant resin material in a bilaterally symmetrical shape. In the following description, the "flange 40L" is the left side (one end side) flange, the "flange 40R" is the right side (the other end side) flange, and the "flange 40" or "flange 40(L,R)" is both of the (left side and right side) flanges.

Parts (a), (b), and (c) of FIG. 10 are schematic views of the flange 40 as seen from an inner surface side, a side surface side, and a top surface side, respectively. Part (d) of FIG. 10 is a longitudinal sectional view of the flange 40. As shown in these figures, the flange 40 includes a preventing surface (a preventing portion, a flange seat, or a first surface) 40*a*, a guiding surface (a guiding portion or a second surface) 40*b*, a pressure-receiving portion 40*c*, an engaging portion 40*d*, and an engaging vertical groove portion 40*e*.

The preventing surface 40*a* opposes a longitudinal end surface 25*d* of the film 25 and performs a function of preventing movement (shift) of the film 25 in a case in which the film 25 moves in the longitudinal direction, so that the film 25 remains at a predetermined position with respect to the longitudinal direction. That is, in the case in which a shift of the film 25 generates, the film end surface 25*d* abuts against the preventing surface 40*a* of the flange 40, so that the shift of the film 25 is prevented.

The guiding surface 40*b* guides the inner surface of the film 25 rotating in an end portion region with respect to the longitudinal direction of the film 25. That is, the guiding surface 40*b* performs a function of causing the film 25 to draw a desired rotation locus by supporting the inner peripheral surface of the film 25 at the longitudinal end portion from the inside of the film 25. A contact region between the guiding surface 40*b* and the film end portion inner surface is indicated by hatched portions Sl and Sr in FIG. 7.

When the end portion inner surface of the rotating film 25 and the guiding surface 50*b* of the flange 40 contact and slide against each other, heat necessary to fix the toner (image) is taken by the flange 40. For that reason, the guiding surface 40*b* is provided in an outside region from a feeding region Wmax of a maximum width-sized sheet usable in the fixing device C.

The engaging portion 40*d* is a portion engaged with the outwardly projected portion 30*a* of the stay 30. The pressure-receiving portion 40*c* directly contacts the outwardly projected portion 30*a* of the stay 30 and performs a function of pressing down the stay 30 by a pressing spring 48(L,R) provided in a compressed state. The flange 40 uses a glass fiber-containing resin material, such as PPS, liquid crystal polymer, polyethylene terephthalate (PET), or polyamide (PA), as a material that is excellent in heat-resistant property and a lubricating property, and that is relatively poor in thermal conductivity, and in this embodiment, PPS is used.

(2) Pressing Roller 26

The pressing roller 26 as a second rotatable member (pressing member) forms the nip N between itself and the film 25 on the heater 20 and is a rotatable driving member for rotationally driving the film 25. The pressing roller 26 is an elastic roller that includes a core shaft portion 26*a*, an elastic layer 26*b* formed on an outer peripheral surface of the core shaft portion 26*a*, and a surface layer 26*c* formed on outer peripheral surface of the elastic layer 26*b* and that is about 30 μm in outer diameter.

As regards the core shaft portion 26*a*, a metallic material, such as aluminum or iron, in a solid or hollow state is used. In this embodiment, solid aluminum is used as the core metal material. The elastic layer 26*b* is formed of a heat-insulative silicone rubber and has electroconductivity by adding thereto an electroconductive material, such as carbon black. The surface layer 26*c* is a parting tube formed of a fluorine-containing resin material such as PFA, PTFE, or FEP in a thickness of 10 μm to 80 μm. In this embodiment, the surface layer 26*c* is a 30 μm-thick PFA tube.

The pressing roller 26 is rotatably provided so that one end side and the other end side of the core shaft portion 26*a* are shaft-supported via bearing members 62 between the side plates 61L and 61R in one end side and the other end side, respectively, of the device frame 60. In the other end side of the core shaft portion 26*a*, a driving gear 47 is provided concentrically integral with the core shaft portion 26*a*. To this gear 47, a driving force of a motor M controlled by a controller (engine controller) D (FIG. 11) is transmitted through a drive transmitting portion (not shown), whereby the pressing roller 26 is rotationally driven as the rotatable driving member at a predetermined peripheral speed in an arrow R26 direction in FIG. 8.

The film unit 50 is provided between the side plates 61L and 61R of the device frame 60 while being disposed substantially parallel to the pressing roller 26 in a side on the pressing roller 26 with the heater 20 surface that faces downward. The engaging vertical groove portions 40*e* of the flanges 40L and 40R of the film unit 50 engage with vertical edge portions of vertical guide slits 63 and 63 provided in the side plates 61L and 61R.

As a result, the flanges 40L and 40R are held slidably (movably) in a vertical (up-down) direction relative to the side plates 61L and 61R. That is, the film unit 50 has a degree of freedom such that the film unit 50 is movable as a whole in directions of moving toward and away from the pressing roller 26 along the vertical guide slits 63 and 63 between the side plates 61L and 61R.

(3) Pressing (Urging) Mechanism

Pressing springs 48L and 48R contact the pressure-receiving portions 40*c* of the flanges 40L and 40R, respectively. The pressing spring 48L is compressedly provided between a spring receiving portion 67L of a top plate 66 in one end side of the device frame 60 and the pressure-receiving portion 40*c* of the flange 40L. The pressing spring 48R is compressedly provided between a spring receiving portion 67R of the top plate 66 in the other end side of the device frame 60 and the pressure-receiving portion 40*c* of the flange 40R.

By compression reaction forces of the pressing springs 48L and 48R, predetermined equal urging forces act on the outwardly projected portions 30*a* and 30*a* of the stay 30 in one end side and the other end side of the film unit 50 via the flanges 40L and 40R.

As a result, the film 25 on the guiding member 29 including the heater 20 press-contacts the pressing roller 26 against the elasticity of the elastic layer 26*b* of the pressing roller 26 with a predetermined pressing force. In the fixing device C in this embodiment, the heater 20, or the heater 20 and a part of the guiding member 29, functions as a sliding member (back-up member) contacting the inner surface of the film 25. For that reason, as shown in FIG. 8, the nip N having a predetermined width with respect to a sheet feeding direction A1 is formed between the film 25 and the pressing roller 26. The film 25 is constrained only in the nip N, and no tension is applied to the film 25.

(4) Fixing Operation

As described above, the driving force of the motor M controlled by the controller D is transmitted to the gear 47 of the pressing roller 26 via the drive transmitting portion, so that the pressing roller 26 is rotationally driven as the rotatable driving member at the predetermined peripheral speed in the arrow R26 direction in FIG. 8. By this rotation of the pressing roller 26, based on a frictional force between the pressing roller 26 and the film 25 at the nip N, a rotational force acts on the film 25. As a result, the film 25 is rotated by the rotational force in an arrow R25 direction at a peripheral speed substantially corresponding to the rotational peripheral speed of the pressing roller 26 while being slid at its inner surface in close contact with the surface of the heater 20 and a part of the outer surface of the guiding member 29.

On the other hand, the heater 20 is supplied with electrical power from an energizing portion (triac) 51, controlled by the controller D, through an unshown energizing path and abruptly generates heat. A temperature of this heater 20 is detected by a thermistor 24 provided in contact with a back (rear) surface of the heater 20, and detected temperature information is inputted to the controller D. The controller D properly controls a current caused to flow from the energizing portion 51 depending on the detected temperature information and increases the temperature of the heater 20 to a predetermined temperature, so that temperature control is carried out.

The thermistor 24 is an element for detecting the temperature of the heater 20 at a longitudinal central portion. The temperature detected by the thermistor 24 is inputted to the controller D. The thermistor 24 is a negative temperature coefficient (NTC) thermistor, so that a resistance value decreases with a temperature rise. The temperature of the heater 20 is monitored by the controller D and is compared with a target temperature set inside the controller D, so that the electrical power supplied to the heater 20 is adjusted. As a result, the electrical power supplied to the heater 20 is controlled so that the heater temperature is maintained at the target temperature.

Thus, in a state in which the pressing roller 26 is rotationally driven and the film 25 is driven with the rotational drive of the pressing roller 26, and then the heater 20 is increased in temperature to the predetermined temperature, the sheet P carrying the unfixed toner image is introduced from the image forming portion B side to the nip N. The sheet P is introduced to the nip N so that a carrying surface of the unfixed toner image T faces the film 25, and is nipped and fed. As a result, the unfixed toner image T on the sheet P is fixed as a fixed image by being heated and pressed. The sheet P that passes through the nip N is curvature-separated from the surface of the film 25 and is fed and discharged from the fixing device C.

Contact Region and Shifting Force at Inner Periphery of Film

As described above, the pressing roller 26 receives the rotational driving force from the driving gear 47 and is rotationally driven in the arrow R26 direction in FIG. 8. The film 25 receives the rotational driving force from the pressing roller 26 in the nip N and is rotated by the rotational driving force. The film 25 generates a shift at either one of a left side and a right side thereof with respect to the longitudinal direction during rotation in some cases. In order to prevent the shift, the flanges 40(L,R) are provided on both end portion sides of the film 25. In the case in which the film 25 generates the shift, the film end surface 25*d* abuts against the preventing surface 40*a* of the flange 40, so that the shift is prevented (limited).

The flange 40 includes the guiding surface 40*b* contacting the end portion inner surface of the film 25 and guides the end portion inner surface of the film 25 in an end portion region of the film 25 with respect to the longitudinal direction. That is, the film 25 is guided at its inner surface in the neighborhood of the both end portions thereof by the guiding surfaces 40*b* of the flanges 40. When the contact regions Sl and Sr (FIG. 7), each between the film end portion inner surface and the associated guiding surface 40*b*, decrease, a problem such that the shifting force increases generates.

The reason therefor will be described with reference to parts (a) and (b) of FIG. 12. Parts (a) and (b) of FIG. 12 are schematic views of the fixing device C on a top surface side at portions of the film unit 50 and the pressing roller 26, in which the film 25 is indicated by a broken line. Further, the stay 30 is omitted from illustration. In a case in which the pressing roller 26 and the film 25 normally rotate, the pressing roller 26 applies a uniform force to the film 25 with respect to the longitudinal direction.

Part (a) of FIG. 12 is the schematic view in the case in which the film 25 is rotated by receiving the uniform force with respect to the longitudinal direction. A feeding force of the pressing roller 26 in the nip N is divided into feeding forces in left and right sides with respect to the longitudinal direction, and the feeding force in the driving gear 47 side (right side) is Hr and the feeding force in the opposite side (left side) is Hl.

The feeding force Hr and the feeding force Hl are the same force, and, for this reason, the shifting force is not generated on the film 25, so that the film end surface 25*d* and the preventing surface 40*a* of the flange 40 are in non-contact with each other on both of the left side and the right side. On the left and right sides, a gap on the left side between the guiding surface 40*b* and a downstream inner surface of the film 25 is represented by dl, and a gap on the right side between the guiding surface 40*b* and the downstream inner surface of the film 25 is represented by dr. At this time, the gap dl and the gap dr are the same interval (distance).

On the other hand, in a case in which the left and right feeding forces Hl and Hr are nonuniform, the shifting force is generated on either one of the left and right sides of the film 25. As to why the left and right feeding forces Hl and Hr are nonuniform, it is possible to cite a case in which an outer diameter of the pressing roller 26 differs between the left and right sides, a case in which the pressing forces of the pressing springs 48L (left side) and 48R (right side) differ from each other, a case in which alignment between the film 25 and the pressing roller 26 on the left side and that on the right side deviate from each other, or a like case.

Part (b) of FIG. 12 is the schematic view in the case where the feeding force Hr is larger than the feeding force Hl. On the driving gear 47 side (right side), the inner surface of the film 25 is guided on the upstream side of the guiding surface 40*a* of the flange 40R, and on the longitudinal opposite side (left side), the film 25 is guided on the downstream side of the guiding surface 40*a* of the flange 40L. As a result, on the driving gear 47 side where the feeding force is large, the film inclines toward the downstream side, and on the longitudinal opposite side, the film 25 inclines toward the upstream side.

When the film 25 inclines by angle θy with respect to the sheet feeding direction A1, a component of force Fy acts on the film 25 on the driving gear 47 side. The component of force Fy increases with an increasing angle θy. As a result, the film 25 shifts toward the driving gear 47 side where the feeding force is large, so that the shift is prevented (limited) by the preventing surface 40*a* of the flange 40R.

Here, the shifting force exerted on the end portion of the film 25 is proportional to the component of force Fy. That is, the shifting force increases with an increasing inclination angle θy. As described above, the inclination of the film 25 is provided by the guiding surface 40*b* of the flange 40, and, therefore, the inclination angle θy increases with an increasing gap dr between the film inner surface and the guiding surface 40*b* of the flange 40. Accordingly, the shifting force can be reduced by decreasing the gap dr (dl).

In order to decrease the gap dr (dl), there is a need to decrease a difference between the inner peripheral surface of the film 25 and the guiding surface 40*b*. Parts (a) and (b) of FIG. 13 are schematic sectional views of a unit formed by the flange 40R on the driving gear 47 side (right side), the heater holder 29, and the heater 20. Incidentally, in FIGS. 1 to 3 and part (a) of FIG. 13 to FIG. 16, shapes of the flange 40, and the like, are deformed for convenience of explanation, and, in comparison with those shapes of the flange 40, and the like, illustrated at least in FIG. 8 and parts (a) to (d) of FIG. 10, and the like, shapes and dimensional ratios, and the like, of respective portions do not coincide with each other.

In parts (a) and (b) of FIG. 13, with respect to the sheet feeding direction A1 at the nip N, the right side is the upstream side (when the flange 40 is divided into two portions on the upstream side and the downstream side along the sheet feeding direction with respect to a nip center line of the nip N). The inner peripheral surface of the film 25 is guided by the guiding surface 40*b* of the flange 40R, the heater holder 29, and the heater 20, and a guiding region is a hatched (shaded) portion Gin part (a) of FIG. 13. Further, a state in which the film 25 is stretched in this guiding region G is shown in part (b) of FIG. 13. A region F, indicated by a bold line in part (b) of FIG. 13, is a film traveling locus (region) in which the inner peripheral surface of the film 25 travels.

It is assumed that a region where the film 25 is not guided by the guiding surface 40*b* generates on the downstream side and that an interval (gap interval) between a most downwardly projected point of the guiding surface 40*b* and the film traveling locus F is dr. This interval dr decreases with a decreasing difference between an inner peripheral length of the film 25, i.e., a full length of the film traveling locus F, and a full length of the guiding region G.

Here, the full length of the guiding region G is Lg, the inner peripheral length of the film 25 is Lf, and a value obtained by dividing Lg by Lf is Rgf (hereafter, Rgf is referred to as an inner periphery usage ratio):

$$Rgf=Lg/Lf.$$

By increasing the inner periphery usage ratio Rgf, the gap dr can be decreased, with the result that the shifting force of the film 25 can be reduced.

On the other hand, when the inner periphery usage ratio Rgf is excessively large, a sliding resistance between the fixing inner peripheral surface and the guiding surface 40*b* increases and thus, a torque increases, and, in addition, it becomes difficult to externally fit the film 25 itself around the inner assembly in some cases.

Accordingly, there is a need that the inner periphery usage ratio Rgf is set in a proper range. As a result, the inner periphery usage ratio Rgf may desirably be set in a range of 95% to 99.8%, and more desirably in a range of 98% to 99%. In this embodiment, the inner periphery usage ratio Rgf was set at 98.5%. As a result, the contact region between the film 25 and the guiding surface 40*b* of the flange 40R is a region (contact region where the guiding surface 40*b* and the end portion inner peripheral surface of the film 25 slide-contact each other, hereafter referred to as a second contact region) indicated by an arrow Jr in part (b) of FIG. 13. This is true for also the case of the flange 40L.

Preventing Surface of Flange and Film Folding

The preventing surface 40*a* of the flange 40R and film folding will be described. Parts (a) and (b) of FIG. 14 are enlarged views of a state in which the end surface 25*d* of the film 25 abuts against the preventing surface 40*a* of the flange 40R when a flange in a reference example is used, and sectional views of the guiding surface 40*a*. During rotation of the film 25, the inner surface of the film 25 and the guiding surface 40*b* of the flange 40R are in contact with each other in the second region Jr, described with reference to part (b) of FIG. 13.

In a state in which the end portion inner surface of the film 25 is not in contact with the guiding surface 40*b*, i.e., in a region in which there is a gap dr between the film traveling locus F and the guiding region G, which are positioned downstream of the second contact region Jr, there is a possibility that a phenomenon such that the film end portion folds (bents) inside generates.

For example, when the shifting force generates in an arrow direction in the figures and the film end surface 25*d* abuts against the preventing surface 40*a*, there is the possibility that the phenomenon occurs in which the film end portion folds inside. Part (a) of FIG. 14 is a schematic view in a state in which the film end portion folds inside by the shifting force. When the film folding generates, there is a possibility that a traveling state of the film 25 is disturbed and thus, causes improper feeding of the sheet and an image defect, and leads to end portion breakage of the film 25 due to stress concentration at a bent portion of the film 25.

On the other hand, as shown in (b) of FIG. 14, in the second contact region Jr where the film end portion inner surface of the film 25 is guided by the guiding surface 40*b*, the folding phenomenon does not generate even when the shifting force generates in the arrow direction in the figure and the film end surface 25*d* abuts against the preventing surface 40*a*. This is because the film inner surface is guided by the guiding surface 40*b*. This is also true for the flange 40L.

In order to solve the problem of the above-described film folding, a method in which a clearance taper-shaped portion is provided on the preventing surface 40*a* of the flange 40R is effective. FIG. 15 is an enlarged schematic view of the flange 40R in the neighborhood of the film end portion in a case in which a taper-shaped portion 40*f* is provided on a downstream side of the preventing surface 40*a* of the flange 40R. By employing this constitution, in a region where the taper-shaped portion 40*f* is provided, the film end surface 25*d* and the preventing surface 40*a* are not in contact with each other, and, therefore, the inward folding phenomenon can be prevented. This is also true for the flange 40L.

On the other hand, however, when the taper-shaped portion 40*f* is formed in an excessively large size, the contact region between the film end surface 25*d* and the preventing surface 40*a* decreases, so that the shifting force per unit area exerted on the film 25 increases. As a result, the film end portion cannot withstand the shifting force, so that a problem of buckling, or the like, generates.

Flange Shape in Embodiment 1

As described above, in order to prevent the breakage of the film 25 and to satisfy durability of the fixing device C, there is a need to satisfy the following two requirements.

A first requirement is "to prevent the end portion folding of the film", and a second requirement is "to reduce the shifting force per unit area exerted on the film". In order to satisfy these requirements, the shape of the flange 40 is required to satisfy the following two conditions. A first condition is that "in a region where the film inner peripheral surface is not guided by the guiding surface, the film end surface is prevented from contacting the preventing surface", and a second condition is that "the contact region between the film end surface and the preventing surface is formed in a large area".

Figure 1:
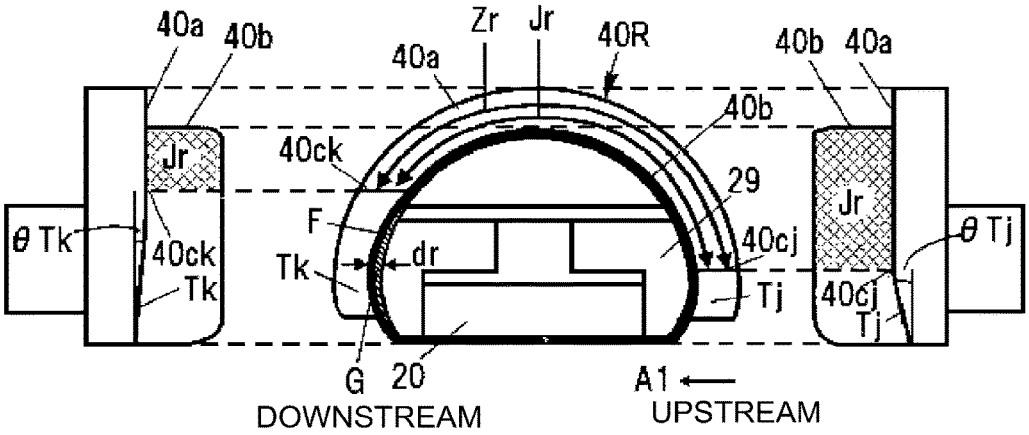
FIG. 1 is a schematic structural view of a flange in a fixing device in Embodiment 1.

The flange 40 in Embodiment 1 satisfies these conditions and thus, can satisfy the durability of the film 25. A central part of FIG. 1 is a schematic sectional view of the flange 40R in Embodiment 1. A right part of FIG. 1 is a schematic view of the flange 40R as seen from an upstream side (when the flange 40R is divided into two portions, i.e., an upstream side portion and a downstream side portion, along the sheet feeding direction A1 with respect to a nip center line) with respect to the sheet feeding direction A1, and a left part of FIG. 1 is a schematic view of the flange 40R as seen from a downstream side with respect to the sheet feeding direction A1.

A region Jr indicated in FIG. 1 by an arrow and a cross-hatched (shaded) portion is a second contact region (second region) where the inner peripheral surface of the film 25 and the guiding surface 40*b* are in contact with each other as described above. In this embodiment, the inner periphery usage ratio Rgf of the flange 40R is 98.5%, with the result that, as shown in FIG. 1, a constitution, in which the second contact region Jr exists not only in the upstream side, but also in the downstream side, is employed. The second contact region Jr continuously extends from a side upstream of the nip center line to a side downstream of the nip center line. In the second region Jr, a length of the film 25 with respect to a rotational direction of the film 25 is greater at a portion upstream of the nip center line than at a portion downstream of the nip center line. By employing such a constitution, the above-described first requirement can be satisfied. That is, by forming the second contact region Jr in the large area, the downstream gap dr can be decreased, with the result that the shifting force exerted on the film 25 can be suppressed to 400 gf or less.

Further, the preventing surface 40*a* of the flange 40R in this embodiment includes a taper-shaped portion Tj (third region) and Tk (first region), each having an inclination in a direction of being spaced from the end portion of the film 25, on the upstream side and the downstream side, respectively, with respect to the nip center line. Taper starting positions of the taper-shaped portions Tj and Tk are represented by 40*cj* on the upstream side and 40*ck* on the downstream side, respectively. The taper-shaped portions Tj and Tk retract in directions of moving away from the longitudinal end portion surface 25*d* of the film 25 relative to the second contact region Jr with respect to the longitudinal direction of the film 25. Further, the taper-shaped portions Tj and Tk incline so as to approach the second contact region Jr with respect to the longitudinal direction of the film 25 as they approach the second contact region Jr with respect to the rotational direction of the film 25. A boundary 40*cj* between the second contact region Jr and the taper-shaped portion Tj is in the same position as the second contact region Jr with respect to the longitudinal direction of the film 25. Further, a boundary 40*ck* between the second contact region Jr and the taper-shaped portion Tk is in the same position as the second contact region Jr with respect to the longitudinal direction of the film 25.

In the starting positions 40*cj* and 40*ck* of the taper-shaped portions Tj and Tk, in order to prevent that the film end surface 25*d* strongly abuts against the preventing surface 40*a* locally, it is desirable that the taper-shaped portions Tj and Tk have shapes (R-shapes) such that a degree of the inclination continuously changes. That is, the shapes of the taper-shaped portions Tj and Tk spacing from the film end surface 25*d* may desirably be shapes free from no discontinuous change in degree of the inclination. In this embodiment, the taper starting positions 40*cj* and 40*ck* of the flange 40R are provided with gentle R shapes on the left and right sides.

Clearance angles of the taper-shaped portions Tj and Tk are represented in FIG. 1 by θTj on the upstream side, and θTk on the downstream side, respectively. The clearance angle θTj of the upstream taper-shaped portion Tj and the clearance angle θJk of the downstream taper-shaped portion Tk are different from each other. In this embodiment, the angle θTk of the downstream taper-shaped portion Tk is less than the angle θTj of the upstream taper-shaped portion Tj. In other words, the clearance angles are set so that θTj is larger than θTk. By setting the clearance angles θTj and θTk in this manner, in the neighborhood of the clearance taper-shaped portion, it is possible to prevent local abutment of the film 25.

The starting positions 40*cj* and 40*ck* of the taper-shaped portions Tj and Tk are asymmetrical on the upstream and downstream sides, and the downstream starting position 40*ck* is disposed closer to a top portion than the upstream starting position 40*cj*. That is, the flange 40R includes the taper-shaped portions Tj and Tk on the upstream side and the downstream side along the sheet feeding direction with respect to the nip center line of the nip N, and the upstream taper-shaped portion Tj is closer to the nip N than the downstream taper-shaped portion Tk.

In a region Zr sandwiched by the starting positions 40*cj* and 40*ck* of the upstream and downstream taper-shaped portions Tj and Tk, the film end surface 25*d* and the preventing surface 40*a* are in contact with each other. That is, the region Zr is a contact region in which, during rotation of the film 25, the preventing surface 40*a* and the end surface 25*d* of the film 25 are in slide-contact with each other (hereafter, this region is referred to as a first contact region). This first contact region Zr is substantially in the same position as the above-described second contact region Jr.

That is, the flange 40R includes the shaped portions Tj and Tk where the preventing surface 40*a* is spaced from the film end surface 25*d*, so that the first contact region Zr and the second contact region Jr are substantially in the same position with respect to a circumferential direction of the film 25 during the rotation of the film 25. Each of the first contact region Zr and the second contact region Jr is provided so as to extend from the upstream side to the downstream side of the nip N with respect to the feeding direction A1 of the sheet P.

Thus, the first contact region Zr and the second contact region Jr are disposed substantially in the same position, so that the above-described first and second requirements are satisfied. That is, the folding can be prevented since the film end surface 25*d* and the preventing surface 40*a* are in contact with each other only at the inner peripheral surface guiding portion, and the force per unit area exerted on the film can be reduced by forming the second contact region Jr in the large area. Further, the preventing surface and the guiding surface are provided from the upstream side to the downstream side with respect to the sheet feeding direction (recording material feeding direction), and, therefore, an attitude of the film is stabilized.

Also in the case of the flange 40L, constitutions are similar to those in the case of the flange 40R described above. Thus, by using the flanges 40(L,R) in this embodiment, even in a high-speed machine in which a higher durable performance is required, durability of the film 25 can be satisfied throughout a lifetime of the film 25.

Modified Embodiment of Embodiment 1

In Embodiment 1, as viewed in the longitudinal direction of the film 25, a boundary 40*ck* of a taper-shaped portion Tk may also be positioned upstream or downstream of the downstream end of the second contact region Jr. In a modified embodiment of Embodiment 1, as shown in FIG. 16, the boundary 40*ck* of a taper-shaped portion Tk is positioned upstream of the downstream end of the second contact region Jr with respect to the rotational direction of the film 25 as viewed in the longitudinal direction of the film 25. FIG. 16 is a schematic sectional view of the flange 40R, and the flange 40F has the same constitution as that of the flange 40R.

As regards the flange 40R in the modified embodiment, a taper starting position 40*ck* of the downstream taper-shaped portion is formed from a top of a guiding surface 40*b* of the flange 40R so as to be parallel to a nip line. At this time, a first contact region where the end surface 25*d* of the film 25 and the preventing surface 40*a* of the flange 40R are in slide-contact with each other is a guide represented by an arrow Zr in the figure, and is a region narrower than a second contact region Jr where the inner peripheral surface of the film 25 and the guiding surface 40*b* are in slide-contact with each other. As a result, a reaction force per unit area exerted on the longitudinal end surface of the film 25 by the preventing surface 40*a* is greater than that in the constitution of Embodiment 1. The first contact region Zr is within a region where the film 25 is guided by the guiding surface 40*b*, however, and, therefore, a rate of occurrence of buckling of the film 25 is small.

In Embodiment 1, the second contact region Jr and the first contact region Zr were provided substantially in the same position, but when a variation is taken into consideration, it is difficult to provide these contact regions in the same position over an entire area. In this case, even in a case in which a tolerance fluctuates to the maximum, it is desirable that setting is made so as to prevent the end portion folding of the film by providing the first contact region Zr so as to be somewhat smaller than the second contact region Jr, as in the modified embodiment, so that the first contact region Zr is not broader than the second contact region Jr. Incidentally, the flange 40R included the taper-shaped portions Tj and Tk, but the flange 40R may also include only the second contact region Jr in the side upstream of the nip center line without providing the taper-shaped portion Tj.

Embodiment 2

Figure 2:
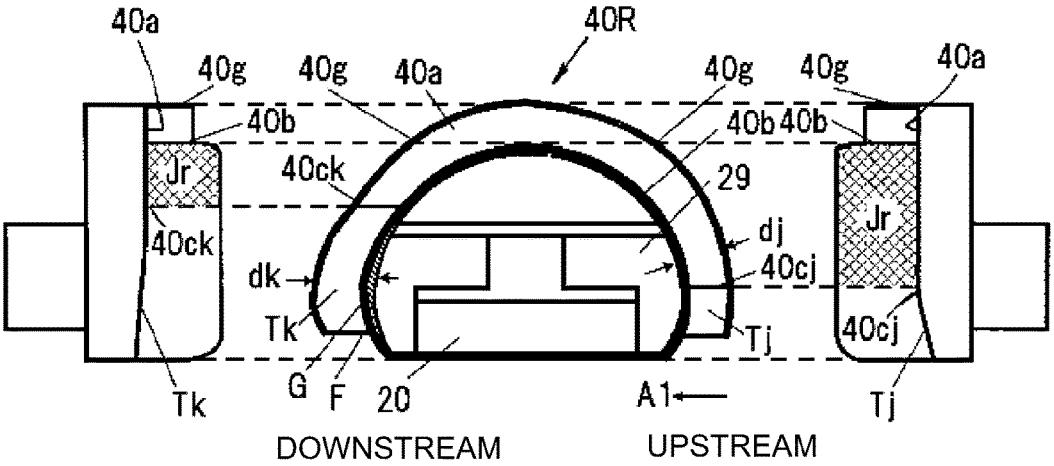
FIG. 2 is a schematic structural view of a flange in a fixing device in Embodiment 2.

A constitution of Embodiment 2 will be described. A difference between Embodiments 1 and 2 exists only with respect to the flanges 40, and other constitutions are the same as those in Embodiment 1, and, therefore, will be omitted from description. A schematic sectional view showing the flange 40 in this embodiment is shown in FIG. 2. The flange 40 in this embodiment has a feature such that the flange 40 includes an eave portion 40*g* on the preventing surface 40*a*.

This eave portion 40*g* performs a function of preventing deformation of the film 25 from a front surface side in a case in which the film 25 is largely deformed during a jam clearance, or the like, for example. For this reason, in order to prevent the film 25 from being largely deformed, there is a need to set a shape of the eave portion 40*g* so as not to be excessively remote from the film traveling locus F.

On the other hand, when the film 25 contacts the eave portion 40*g* during normal printing, there is a possibility that a problem, such as abrasion of the surface layer or a torque increase, generates. That is, even when the eave portion 40*g* is excessively remote from or excessively close to the traveling locus F of the film 25, there is a possibility of generation of the problem.

Accordingly, in the flange 40 in this embodiment, as regards a distance between the eave portion 40*g* and the guiding surface 40*b*, a distance dj on the upstream side and a distance dk on the downstream side provide a difference therebetween. Specifically, a certain interval (gap) dj is ensured on the preventing surface 40*a* from the upstream taper-shaped portion starting position 40*cj* to the downstream taper-shaped portion starting position 40*ck*. On the other hand, in the side downstream of the downstream taper-shaped portion starting position 40*ck*, an interval (gap) dk is greater than the interval dj.

That is, the flange 40 includes the eave portion 40*g* covering the outer peripheral surface of the film 40 at the end portion. Further, between the downstream taper-shaped portion Tk and the upstream taper-shaped portion Tj, the distance from the eave(-shaped) portion 40*g* to the second contact region Jr is dj, and the distance from the eave(-shaped) portion 40*g*, in the region downstream of the downstream taper-shaped portion Tk, to the second contact region Jr is dk. The distance dj is less than the distance dk.

By employing such a constitution, even in the downstream region in which the film traveling locus F is spaced from the guiding region G, the film traveling locus F and the eave portion 40*g* fall within a predetermined distance. As a result, a good fixing image can be provided without generating the problem not only during the printing but also during the jam clearance.

Embodiment 3

In order to obtain a good image, a means for applying, to the electroconductive base layer 25*a* (part (b) of FIG. 9) of the film 25, a bias (potential) of an opposite polarity "+" in this embodiment) to a charge polarity ("−" in this embodiment) of the toner is effective. By applying the bias to the film 25, a force of the electric field acts in a direction of pressing the unfixed toner (image) T toward the sheet P. By this force of the electric field, a phenomenon that the toner T scatters toward a rear side of the sheet P can be suppressed.

Therefore, in this embodiment, at the end portion of the film 25 in the fixing device of Embodiment 1, the electroconductive base layer 25*a* is exposed along a circumferential direction of the film 25. Then, to this exposed portion of the base layer 25*a*, a predetermined bias is applied from a bias applying portion 53, controlled by the controller D (FIG. 11), through an energizing means (energizing mechanism) 52, such as an electroconductive brush.

Figure 3:
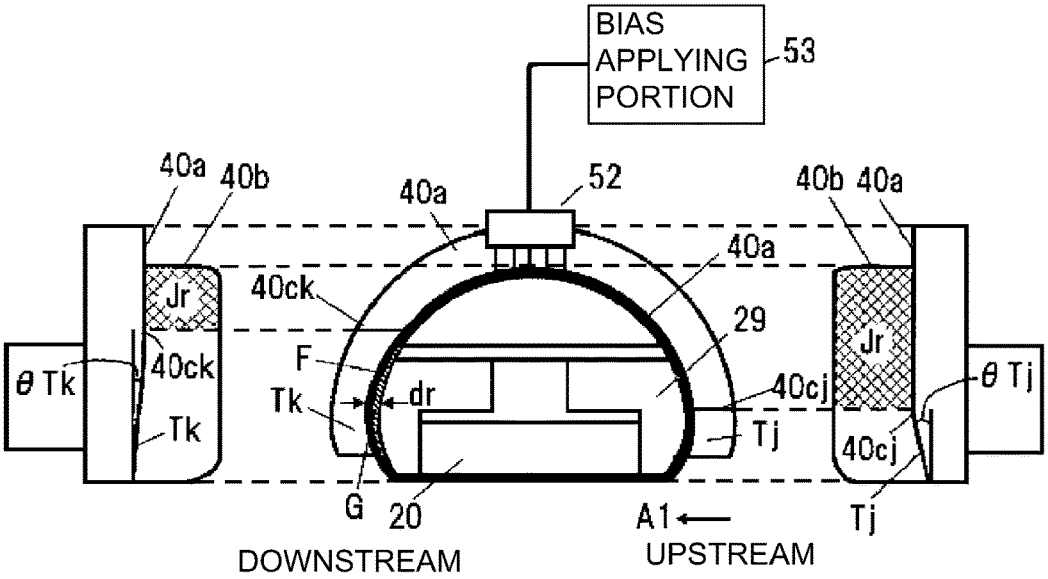
FIG. 3 is a schematic structural view of a flange in a fixing device in Embodiment 3.

FIG. 3 is a schematic sectional view showing the flange 40R and the energizing mechanism 52 in this embodiment. In this embodiment, the negative bias is supplied from the front surface side of the film 25 by a brush-type energizing mechanism 52. At this time, when the bias is supplied in a region where the film end portion inner surface does not contact the guiding portion (guiding surface) 40*b*, a contact point between the brush energizing mechanism 52 and the film 25 becomes unstable due to rotational motion, and noise generates, with the result that a proper bias cannot be applied to the film 25.

Accordingly, in this embodiment, a constitution in which the energizing mechanism 52 is provided in the second contact region Jr, where the film end surface inner surface contacts the guiding surface 40*b*, was employed. That is, the energizing mechanism 52 was disposed in a region sandwiched between the taper starting position 40*cj* of the upstream taper-shaped portion Tj and the taper starting position 40*ck* of the downstream taper-shaped portion Tk. As a result, even in a case in which the film 25 performs the rotational motion, the energization can be stably carried out and thus, generation of the image defect can be prevented.

Incidentally, also in the flange 40 including the eave portion 40*g* described in Embodiment 2, the energizing mechanism 52 can be provided. In this case, there is a need that the eave portion 40*g* is not provided in the region where the energizing mechanism 52 is disposed. That is, the energizing mechanism 52 for applying the potential to the surface of the film 25 is provided in the second contact region Jr, and the eave portion 40*g* is not provided in the region where the energizing mechanism 52 is positioned.

OTHER EMBODIMENTS (1) The pressing constitution, of the film unit 50 and the pressing roller 26, for forming the nip N, can also be changed to a device constitution for pressing the pressing roller 26 against the film unit 50. A device constitution for pressing the film unit 50 and the pressing roller 26 against each other can also be employed. That is, the pressing constitution may only be required to employ a constitution in which at least one of the film unit 50 and the pressing roller 26 is pressed toward the other.

(2) The sliding member (back-up member) provided inside the film 25 may also be a member other than the heater 20.

(3) The heating means for heating the film 25 is not limited to the heater 20. It is possible to employ appropriate heating constitutions using other heating means, such as a halogen heater and an electromagnetic induction coil, in which the heating constitution is one of an internal heating constitution, an external heating constitution, a contact heating constitution, and a non-contact heating constitution.

(4) In this embodiment, the flange 40 is provided on both sides (one end side and the other end side), but a device constitution such that the shift (movement) of the film 24 exclusively generates on one end side or on the other end side and that the flange 40 is provided on the shift (movement) side can also be employed.

(5) A device constitution in which the film 25 is the rotatable driving member, and the pressing roller 26 is rotated by the rotation of the film 25 can also be employed.

(6) In this embodiment, as the image heating apparatus, the fixing device for fixing the unfixed toner image formed on the recording material through heating was described as an example, but the present invention is not limited thereto. The present invention is also applicable to a device (glossiness improving device) for improving glossing (glossiness) of an image by re-heating a toner image fixed, or temporarily fixed, on the recording material.

(7) The image forming apparatus is not limited to the image forming apparatus for forming the monochromatic image, as in the above-described embodiments, but may also be an image forming apparatus for forming a color image. Further, the image forming apparatus can be used to carry out various other purposes, such as a copying machine, a facsimile machine, and a multi-function machine having a plurality of functions of these machines, by adding necessary device, equipment, and casing structure.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A fixing device comprising:

(A) a cylindrical film;

(B) a pressing member configured to form a nip in cooperation with said film while contacting an outer surface of said film; and (C) a preventing member provided at a longitudinal end portion of said film and contactable to a longitudinal end surface of said film when said film moves in a longitudinal direction of said film, said preventing member including:

(a) a guiding surface opposing an inner surface of said film and configured to guide rotation of said film; and (b) a preventing surface configured to prevent movement of said film in the longitudinal direction of said film, wherein, as viewed in the longitudinal direction of said film, said preventing surface includes:

(i) a first region positioned downstream of a nip center line with respect to a recording material feeding direction; and (ii) a second region positioned upstream of the first region with respect to the recording material feeding direction, the first region retracting in a direction of retracting from the longitudinal end surface of said film with respect to the longitudinal direction of said film relative to the second region, wherein the second region and a region of said guiding surface, which is contactable to the inner surface of said film when said film rotates, extend continuously in the recording material feeding direction from a portion upstream of the nip center line to a portion downstream of the nip center line, and each of the second region and the region of said guiding surface, which is contactable to the inner surface of said film when said film rotates, has a length, with respect to a rotational direction of said film, that is greater at the portion upstream of the nip center line than at the portion downstream of the nip center line, wherein, as viewed in the longitudinal direction of said film, with respect to the rotational direction of said film, an upstream end of the second region is positioned downstream of an upstream end of the region of said guiding surface, which is contactable to the inner surface of said film when said film rotates, and wherein, in the nip, a recording material, on which an image is formed, is heated while being fed, and the image is fixed on the recording material.

2. The fixing device according to claim 1, wherein the first region inclines so as to approach the second region in the longitudinal direction of said film as the first region approaches the second region in the rotational direction of said film.

3. The fixing device according to claim 1, wherein said preventing surface further includes (iii) a third region positioned downstream of the second region with respect to the rotational direction of said film, and the third region retracts in a direction of retracting from the longitudinal end surface of said film with respect to the longitudinal direction of said film.

4. The fixing device according to claim 3, wherein the first region inclines so as to approach the longitudinal end surface toward a downstream side with respect to the rotational direction of said film, and the third region inclines so as to be spaced from the longitudinal end surface toward the downstream side with respect to the rotational direction of said film.

5. The fixing device according to claim 4, wherein a degree of inclination of the first region is less than a degree of inclination of the third region.

6. The fixing device according to claim 1, wherein no tension is applied to said film.

7. The fixing device according to claim 1, further comprising (D) a nip forming member that forms the nip in cooperation with said pressing member through said film.

8. The fixing device according to claim 7, wherein said nip forming member is a heater.

9. A fixing device comprising:

(A) a cylindrical film;

(B) a pressing member configured to form a nip in cooperation with said film while contacting an outer surface of said film; and (C) a preventing member provided at a longitudinal end portion of said film and contactable to a longitudinal end surface of said film when said film moves in a longitudinal direction of said film, said preventing member including:

(a) a guiding surface opposing an inner surface of said film and configured to guide rotation of said film; and (b) a preventing surface configured to prevent movement of said film in the longitudinal direction of said film, wherein, as viewed in the longitudinal direction of said film, said preventing surface includes:

(i) a first region positioned downstream of a nip center line with respect to a recording material feeding direction;

(ii) a second region positioned upstream of the first region with respect to the recording material feeding direction, the first region retracting in a direction of retracting from the longitudinal end surface of said film with respect to the longitudinal direction of said film relative to the second region, wherein the second region extends continuously in the recording material feeding direction from a portion upstream of the nip center line to a portion downstream of the nip center line, and the second region has a length, with respect to a rotational direction of said film, that is greater at the portion that is upstream of the nip center line than at the portion that is downstream of the nip center line; and (iii) a third region positioned downstream of the second region with respect to the rotational direction of said film, the third region retracting in a direction of retracting from the longitudinal end surface of said film with respect to the longitudinal direction, wherein the first region inclines so as to approach the longitudinal end surface toward a downstream side with respect to the rotational direction of said film, and the third region inclines so as to be spaced from the longitudinal end surface toward the downstream side with respect to the rotational direction of said film, and wherein a degree of inclination of the first region is less than a degree of inclination of the third region, and wherein, in the nip, a recording material, on which an image is formed, is heated while being fed, and the image is fixed on the recording material.

10. The fixing device according to claim 9, further comprising (D) a nip forming member that forms the nip in cooperation with said pressing member through said film.

11. The fixing device according to claim 10, wherein said nip forming member is a heater.

12. A fixing device comprising:

(A) a cylindrical film;

(B) a pressing member configured to form a nip in cooperation with said film while contacting an outer surface of said film; and (C) a preventing member provided at a position opposing a longitudinal end surface of said film and contactable to the longitudinal end surface of said film when said film moves in a longitudinal direction of said film, said preventing member including:

(a) a guiding surface opposing an inner surface of said film and configured to guide rotation of said film; and (b) an opposing surface configured to prevent movement of said film in the longitudinal direction of said film, wherein, as viewed in the longitudinal direction of said film, said opposing surface includes:

(i) a first region positioned downstream of a nip center line with respect to a recording material feeding direction; and (ii) a second region positioned upstream of the first region with respect to the recording material feeding direction, the first region retracting in a direction of retracting from the longitudinal end surface of said film with respect to the longitudinal direction relative to the second region, wherein the second region and a region of said guiding surface, which is contactable to the inner surface of said film when said film rotates, extend continuously in the recording material feeding direction from a portion upstream of the nip center line to a portion downstream of the nip center line, and each of the second region and the region of said guiding surface that is contactable to the inner surface of said film when said film rotates has a length, with respect to a rotational direction of said film, that is greater at the portion that is upstream of the nip center line than at the portion that is downstream of the nip center line, and wherein, as viewed in the longitudinal direction of said film, with respect to the rotational direction of said film, an upstream end of said second region is positioned at one of (i) a position downstream of an upstream end of the region of said guiding surface, which is contactable to the inner surface of said film when said film rotates, and (ii) at the same position as the upstream end of the region of said guiding surface, which is contactable to the inner surface of said film when said film rotates, and wherein, in the nip, a recording material, on which an image is formed, is heated while being fed, and the image is fixed on the recording material.

13. The fixing device according to claim 12, wherein the first region inclines so as to approach the longitudinal end surface toward a downstream side with respect to the rotational direction of said film.

14. The fixing device according to claim 12, wherein said opposing surface further includes (iii) a third region positioned downstream of the second region with respect to the rotational direction of said film, and the third region retracts in a direction of retracting from the longitudinal end surface of said film with respect to the longitudinal direction of said film.

15. The fixing device according to claim 14, wherein the first region inclines so as to approach the longitudinal end surface toward a downstream side with respect to the rotational direction of said film, and the third region inclines so as to be spaced from the longitudinal end surface toward the downstream side with respect to the rotational direction of said film.

16. The fixing device according to claim 15, wherein a degree of inclination of the first region is less than a degree of inclination of the third region.

17. The fixing device according to claim 12, further comprising (D) a nip forming member that forms the nip in cooperation with said pressing member through said film.

18. The fixing device according to claim 17, wherein, as viewed in the longitudinal direction of said film, with respect to the rotational direction of said film, when a length of a guiding region G formed by the region of said guiding surface and the nip forming member is Lg and an inner peripheral length of said film is Lf, an inner periphery usage ratio Rgf, defined as Lg/Lf, is in a range of 95% to 99.8%.

19. The fixing device according to claim 17, wherein said nip forming member is a heater.

* * * * *